US005207726A

United States Patent [19]

Rathweg

[11] Patent Number: 5,207,726

[45] Date of Patent: May 4, 1993

[54] HYDRAULIC PUMP

[76] Inventor: Christopher Rathweg, Rte. 1, Box 218-7, Espanola, N. Mex. 87532

[21] Appl. No.: 741,094

[22] Filed: Aug. 6, 1991

[51] Int. Cl.[5] ..... F04B 47/08

[52] U.S. Cl. ..... 417/393; 91/329; 91/313

[58] Field of Search ..... 417/393; 91/313, 329, 91/378

[56] References Cited

U.S. PATENT DOCUMENTS

| | | | |
|---|---|---|---|
| 373,500 | 11/1887 | Sylvester | 91/348 |
| 2,562,584 | 9/1951 | Soberg | 417/378 |
| 2,787,223 | 4/1957 | Sargent | 91/313 |
| 2,821,141 | 1/1958 | Sargent | 91/313 |
| 2,837,030 | 6/1958 | Laster et al. | 417/392 |
| 2,925,782 | 2/1960 | Sharpe | 91/348 |
| 2,933,071 | 4/1960 | Sargent | 91/313 |
| 2,948,224 | 8/1960 | Bailey et al. | 417/404 |
| 3,064,582 | 11/1962 | Knights | 91/313 |
| 4,405,291 | 9/1983 | Canalizo | 91/313 |
| 4,616,981 | 10/1986 | Simmons et al. | 417/378 |
| 4,744,334 | 5/1988 | McInally | 119/78 |

*Primary Examiner*—Richard A. Bertsch
*Assistant Examiner*—Peter Korytnyk
*Attorney, Agent, or Firm*—Rod D. Baker

[57] ABSTRACT

An improved control mechanism for submerged reciprocating hydraulic pumps comprising, in combination with pump cylinders, pistons and valves, a two-stage flow reversing mechanism in which action of the pump pistons drives a valve pilot means between two rest positions; relocation of the pilot means in turn causes relocation of a spatially separated spool mechanism between two rest positions, thereby causing reversal of flow of fluid while the pump is driven by a one-way pressurizing pump. The two-stage reversing mechanism eliminates the possibility of having the reciprocating mechanism come to rest in a "dead center" or equilibrium position. The spool is mounted concentrically with the pump shaft, optimizing flow potential. The mechanism is relatively easy to assemble and repair.

10 Claims, 3 Drawing Sheets

HYDRAULIC PUMP

BACKGROUND OF THE INVENTION

Pumping jacks and sucker rods are still the prevalent pump system for production from deep wells. This system has numerous disadvantages. Slightly irregular or narrow bore wells cause sucker rods to contact the production tubing, resulting in appreciable power losses during the pumping cycle and increased wear upon pumping facilities. Very crooked wells may cause sucker rods to break. Even in straight bores these systems have disadvantages. Much of the pumping power is consumed in overcoming the inertia of the sucker rods, and the transfer of energy to a submerged pump through weightbearing mechanical members results in additional friction losses as well as additional maintenance and replacement of bearing parts. In addition, the transfer of energy through the mechanical sucker rod requires high strength materials, resulting in heavy strings of sucker rod and the associated jack mechanism. This makes equipment purchase, installation and ongoing servicing costly, particularly in remote locations.

Pumping of wells by means of surface-driven fluid pressure eliminates the need for sucker rods and pumping jacks, but has, heretofore, presented other problems. For example, one such method is to reciprocate a surface-driven fluid thereby reciprocating a pumping piston within the well. Reciprocating the fluid results in substantial losses of energy due to the expansion and contraction of the tubing confining and transferring the reciprocating fluid pressure. If rigid pipe is used to reduce these losses, weight and cost once again become a disadvantage.

These problems may be eliminated by employing a pump within the well using a continuous (non-reciprocating) surface-injected fluid pressure, but this method presents its own difficulties. One of particular importance has been termed the dead center problem, which occurs when a submerged reciprocating pump which actuates its own reversing system comes to rest at a position of hydraulic equilibrium and thus ceases to function. Bailey (U.S. Pat. No. 2,948,224) overcomes this problem by employing a hydraulic pump within the well which reciprocates by means of a pilot-actuated, pressure-operated valve switching means, but the Bailey design is complex and has a limit on its size, and therefore its flow potential, for a given outer diameter.

SUMMARY OF THE INVENTION

Accordingly, an object of the present invention is to provide a pump for wells which may operate without a pumping jack and sucker rods and which may utilize driving means of lesser power for comparable pumping capacity, and particularly solar-powered driving means.

Another object of the invention is to provide a pump of high reliability which may be compactly constructed for slim hole production, and which will minimize flow restrictions in a well bore of limited diameter.

A further object of the invention is to provide a reciprocating pump which is not susceptible to dead center or equilibrium locking.

A further object of the invention is to permit easy installation, disassembly and maintenance of the pump mechanism, with easily replaceable wearing surfaces and seals.

A further object of the invention is to provide a pump which can operate efficiently using non-rigid tubing.

A further object of the invention is to provide a pump which will operate efficiently in a slanted or horizontal bore well.

Further objects will be apparent from the drawings and descriptions.

DETAILED DESCRIPTION OF THE PREFERRED EMBODIMENT

Figure 1:
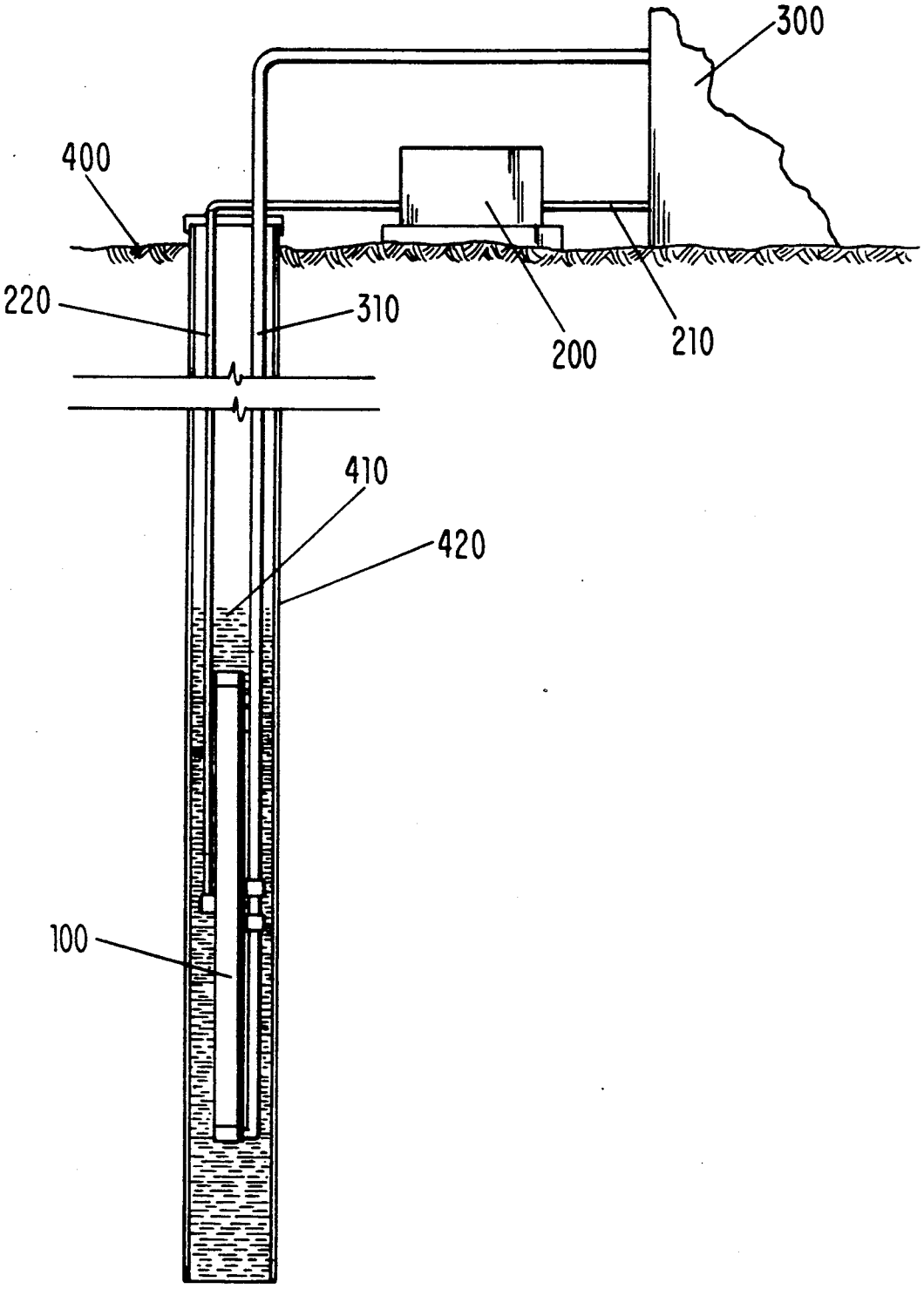
FIG. 1 is a schematic representation of a complete pumping system in which the invention may be utilized.

A complete operating system is schematically illustrated in FIG. 1. Reservoir 300, located on the surface of the ground 400, is connected by tubing 210 to the intake port of a conventional pressurizing pump 200. The outlet port of pressurizing pump 200 is connected by tubing 220 to the submersed pump, generally indicated by 100, located below the surface of the liquid 410 and within a well casing 420. The down hole pump, generally indicated by 100, is connected by tubing 310 with reservoir 300 on the surface of the ground.

Figure 2:
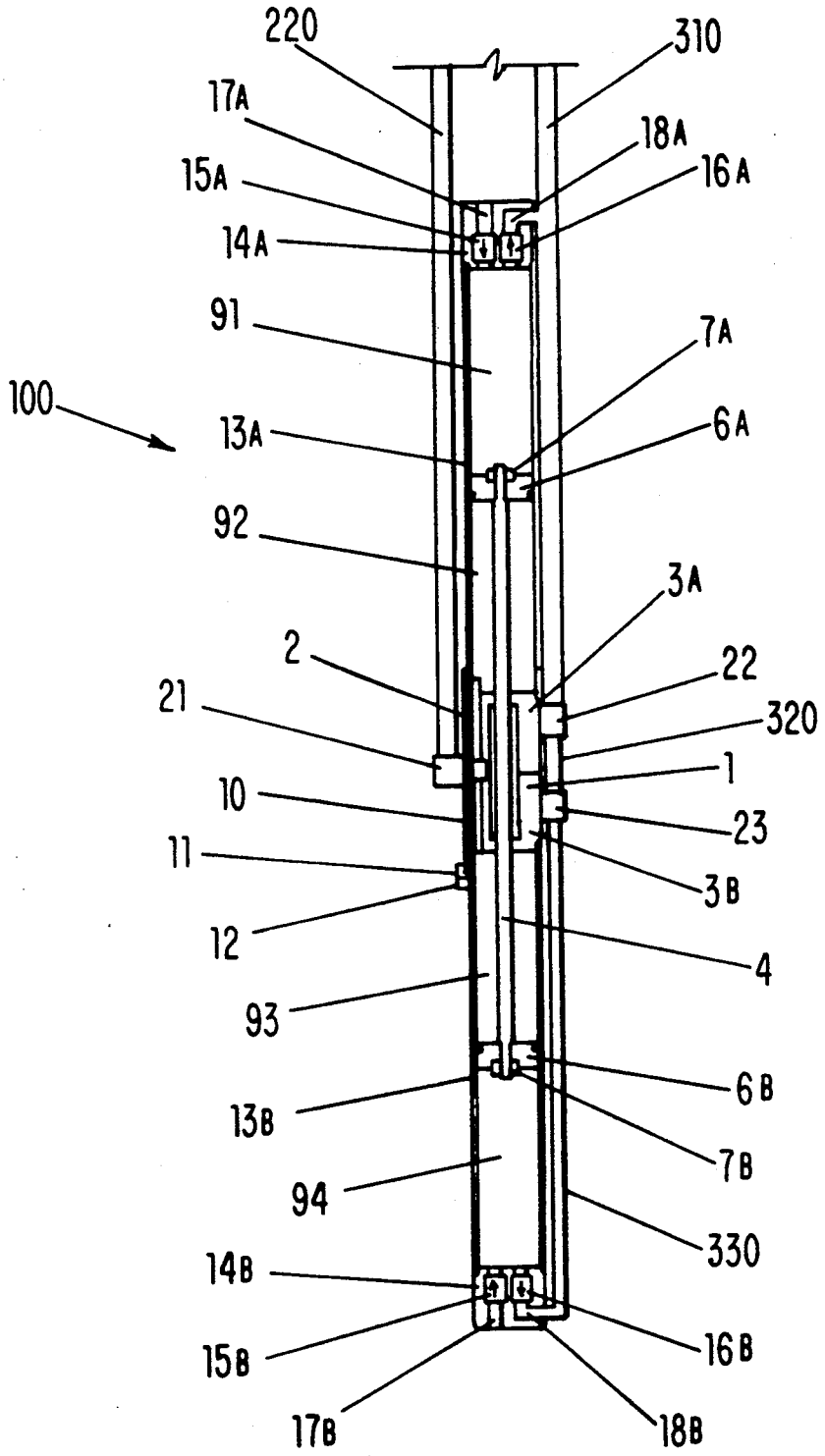
FIG. 2 is a detailed representation of the submersed portion of the pumping system.
Figure 3:
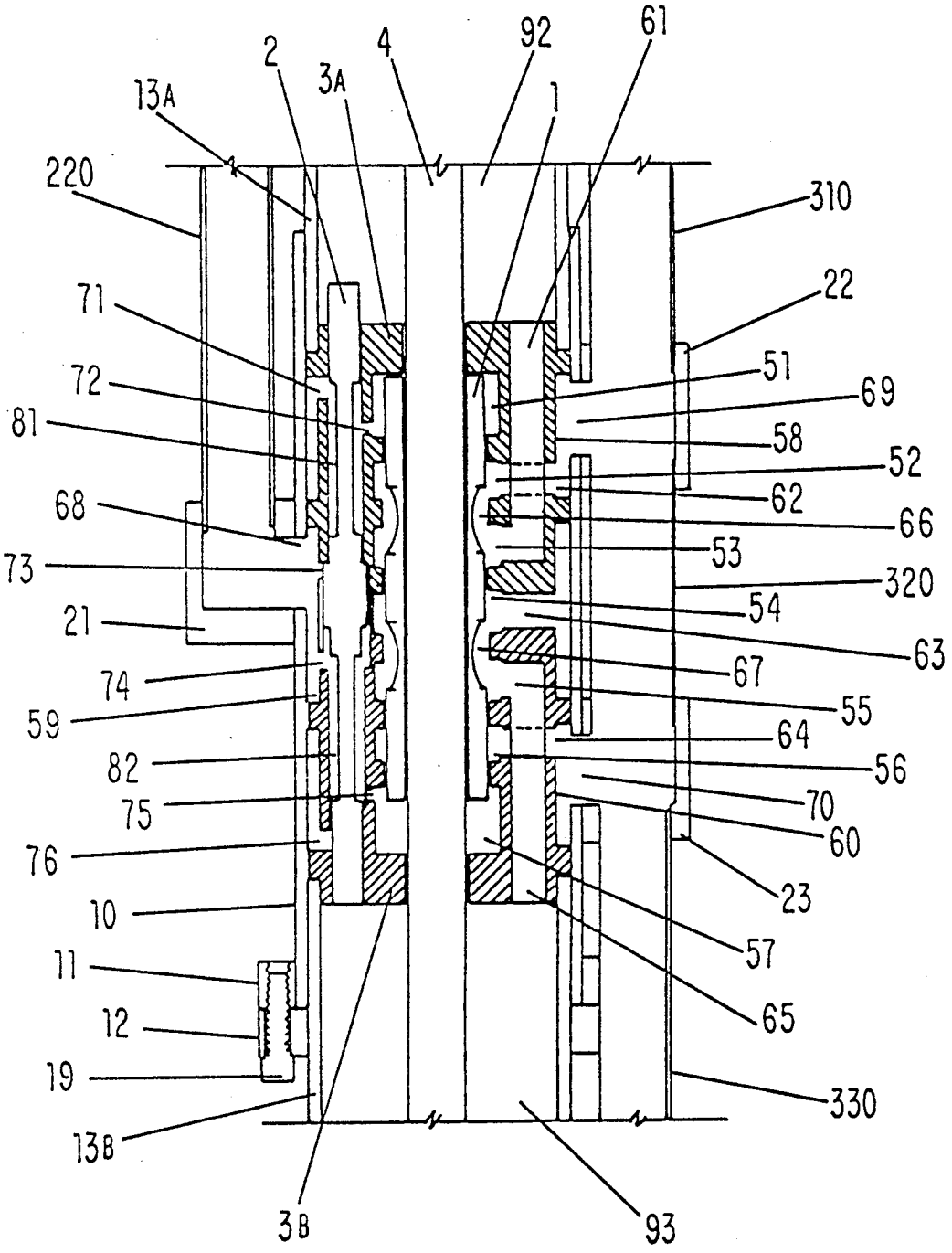
FIG. 3 is a cross-sectional view through the reciprocating control mechanism for the system.

Referring to FIGS. 2 and 3, the down hole pump, generally indicated by 100, includes the following elements: Drive manifold 21 is conventionally secured to the lower end of tubing 220 and also to the valve body liner 10 at opening 68. Valve body liner 10 is secured coaxially to the lower end of upper cylinder 13A. Upper flange 11 is conventionally secured to the lower end of valve liner 10. Upper cylinder head 14A is conventionally secured to the top end of upper cylinder 13A. Upper cylinder head 14A contains intake valve 15A, allowing one-way flow from intake port 17A to pumping chamber 91. Upper cylinder head 14A also contains outlet check valve 16A, allowing one-way flow from pumping chamber 91 to outlet port 18A, and thereafter to outlet tubing 310.

Lower flange 12 is conventionally secured at any convenient location near the upper end of lower cylinder 13B. The lower end of lower cylinder 13B is secured to lower cylinder head 14B, which contains intake check valve 15B, allowing one-way flow from intake port 17B to pumping chamber 94. Lower cylinder head 14B also contains outlet check valve 16B, allowing one-way flow from pumping chamber 94 to outlet port 18B and then to outlet tubing 330. Check valves 15A, 16A, 15B, and 16B are illustrated generally, since this invention is not limited to particular types or characteristics of such valves.

The top end of outlet tube 330 is releasably secured to outlet manifold 23. Tubing 320 connects with and provides communication between outlet manifold 23 and outlet manifold 22. Outlet manifolds 22 and 23 are conventionally secured to valve liner 10 a openings 69 and 70 respectively. It should be noted that, while tubing 220, drive manifold 21 and opening 68 are illustrated, for clarity of presentation in FIGS. 1, 2 and 3, on the opposite side of the down hole pump from tubing 330, 320, 310, manifolds 22, 23 and openings 69 and 70, it is preferred to reduce the down hole pump's diameter by placing these openings and associated manifolds and tubes as close as possible to each other on one side of the down hole pump.

Contained within valve bodies 3A and 3B is pilot 2, as well as spool 1, which is positioned coaxially with valve bodies 3A and 3B. A shaft 4 passes coaxially through valve bodies 3A and 3B and spool 1, extending from pumping chamber 92 to pumping chamber 93. Piston 6A is secured with nut 7A to the upper end of shaft 4. Piston 6B is secured with a nut 7B to the lower end of the shaft 4. A suitable packing may be employed on pistons 6A and 6B to provide a seal between respective pistons and cylinders. The piston assembly (pistons 6A, 6B, nuts 7A, 7B and shaft 4) is free to move longitudinally along the axis of cylinders 13A and 13B.

Upper flange 11 and lower flange 12 are attached to each other with threaded fasteners 19, axially spaced. Removing fasteners 19 allows lower cylinder 13B and lower flange 12 to be separated from valve liner 10 and upper flange 11, providing simple means of inserting or removing the valve/piston assembly. Valve bodies 3A and 3B are not fastened to each other, but are confined within valve liner 10 when upper flange 11 and lower flange 12 are secured as described. Spool 1 is a cylinder free to move longitudinally a small distance within the valve bodies 3A and 3B. Two reductions in diameter occur along the outer surface of spool 1 providing annular cavities 66 and 67. Packing may be employed to provide a seal between spool 1 and shaft 4 and between spool 1 and the valve body 3A and 3B.

Pilot 2 is a rod having an increased diameter in the center, and reductions in diameter toward both ends. The increased diameter in the center provides two shoulders which trap the pilot within the two valve bodies 3A and 3B. The reductions in diameter toward both ends provide annular cavities 81 and 82. Pilot 2 is free to move longitudinally a small distance within a bore in valve bodies 3A and 3B.

Valve bodies 3A and 3B together serve as a manifold for spool 1 and pilot 2. They are identical parts with a stepped bore through their axial length. A packing may be employed in the smaller diameter of the stepped bore, providing a seal between shaft 4 and valve bodies 3A and 3B. The larger diameter of the stepped bore contains many grooves along its length, creating annular cavities 51, 52, 53, 54, 55, 56 and 57. Packings may be employed between these cavities to provide a seal between valve bodies 3A and 3B and spool 1. The outer diameter of valve bodies 3A and 3B have changes in diameter defining annular cavities 58, 59 and 60. Suitable packings may be employed between these cavities to provide a seal between valve bodies 3A and 3B and the valve body liner 10. Also, suitable packings may be used between the end of each valve body and each pumping chamber to provide a seal. Passages are provided in valve bodies 3A and 3B providing the following connections: Passage 61 provides communication between pumping chamber 92 and annular cavity 53. Passage 62 provides communication between annular cavity 58 and annular cavity 52. Passage 63 provides communication between annular cavity 59 and annular cavity 54. Passage 65 provides communication between pumping chamber 93 and annular cavity 55. Passage 64 provides communication between annular cavity 60 and annular cavity 56. Additional passages similar to passages 61, 62, 63, 64, and 65, may be provided many times axially so as to increase the flow potential. Other passages (pilot ports) are provided in valve bodies 3A and 3B providing the following connections: Passage (pilot port) 72 provides communication between annular cavity 51 and the pilot bore. Passage (pilot port) 71 provides communication between annular cavity 58 and the pilot bore. Passages (pilot ports) 73 and 74 provide communication between annular cavity 59 and the pilot bore. Passages (pilot port) 75 provide communication between annular cavity 57 and the pilot bore. Passage (pilot port) 76 provides communication between annular cavity 60 and the pilot bore.

OPERATION

Pressurizing pump 200 at the surface of the ground 400 draws fluid through tubing 210 from reservoir 300, forcing said fluid through tubing 220 to the down hole pump 100 located below the surface of the fluid 410 within a well casing 420. Fluid under pressure passes from tubing 220 through manifold 21 through opening 68 into annular cavity 59, through passage 63 into annular cavity 54. Assuming that spool 1 and pilot 2 are in their upper positions (as illustrated in FIG. 3), within valve bodies 3A and 3B, fluid under pressure then passes from annular cavity 54, through annular cavity 67 to annular cavity 55. From annular cavity 55, the pressurized fluid passes through passage 65 into the interior of pumping chamber 93. Pressure in pumping chamber 93 drives the lower piston 6B downwardly and consequently carries shaft 4 and upper piston 6A downwardly as well. Fluid below lower piston 6B within pumping chamber 94 is discharged through outlet check valve 16B, then through outlet port 18B, into tubing 330. Concurrently, fluid below upper piston 6A, within pumping chamber 92, is discharged through passage 61 into annular cavity 53, through annular cavity 66, through annular cavity 52, through passage 62, through annular cavity 58, through opening 69, into manifold 22. As upper piston 6A moves downwardly, fluid is drawn from above into pumping chamber 91 through intake check valve 15A and intake port 17A. A pistons 6A and 6B approach the lower end of their respective cylinders 13A and 13B, the bottom surface of upper piston 6A engages the top end of pilot 2. As upper piston 6A continues its downward movement, it moves pilot 2 until pilot ports 71 and 74 are blocked and pilot ports 73 and 76 are opened. At this point fluid under pressure then passes from annular cavity 59 through passageway 73, through annular cavity 81 and through passageway 72 into annular cavity 51. Since the fit between the upper surface of spool 1 and the adjacent contacting surface of valve body 3A is not fluid-tight, fluid under pressure is free to enter between said surfaces, thereby driving spool 1 downward. Fluid below spool 1 in annular cavity 57 is evacuated through passageway 75 into annular cavity 82, through port 76 into annular cavity 60. The downward travel of spool 1 continues until its lower surface contacts the bottom of annular cavity 57. Now, pilot 2 and spool 1 are in their lower positions. With spool 1 in its lower position, pressurized fluid passes from annular cavity 54 through annular cavity 66, to annular cavity 53. From annular cavity 53, the pressurized fluid passes through passage 61 into the interior of pumping chamber 92. Pressure in pumping chamber 92 drives the upper piston 6A upwardly and consequently carries shaft 4 and lower piston 6B upwardly as well. Fluid above upper piston 6A, within pumping chamber 91, is discharged through outlet check valve 16A, through outlet port 18A into tubing 310. Fluid above lower piston 6B within pumping chamber 93 is discharged through passage 65 into annular cavity 55, into annular cavity 67, through annular cavity 56, through passage 64, through annular cavity 60 through opening 70 into the space defined by manifold 23.

Concurrently, as lower piston 6B moves upward, fluid is drawn into pumping chamber 94 from intake check valve 15B and intake port 17B. As pistons 6A and 6B approach the top end of their respective cylinders 13A and 13B, the top surface of the lower piston 6B engages the lower end of pilot 2. The lower piston 6B will continue its upward movement, consequently raising pilot 2 until pilot ports 73 and 76 are blocked and pilot ports 71 and 74 are opened. At this point, fluid under pressure then passes from annular cavity 59, through port 74, through annular cavity 82, through passageway 75 into annular cavity 57, driving spool 1 upward. Fluid above spool 1 in annular cavity 51 is evacuated through passageway 72 into annular cavity 81, through port 71, into annular cavity 58.

The upward travel of spool 1 continues until its upper surface contacts the top of annular cavity 51. Now pilot 2 and spool 1 are in their upper positions, and one cycle is complete and another ready to begin. Fluid discharged into tubing 330, manifold 23, manifold 22, and tubing 310 combines to flow upward through tubing 310 to be discharged into reservoir 300 at the surface.

If the pistons are of equal diameter and the shaft diameter is significantly less than that of the pistons, then for each volume of fluid pumped down tubing 220, approximately twice that volume will be discharged from tubing 310 into the reservoir.

From the foregoing, it can be seen that there has been disclosed a novel two-stage switching means for use in a reciprocating hydraulic pumping system. Turbulence, with resulting inefficiency, has been reduced by making use of the concentric spool to provide a less-constricted flow pattern. Components are simple to fabricate and assemble. The use of a reciprocating pilot and spool mechanism, in which the pilot is driven by the piston to an alternate position, closely followed by a similar repositioning of the spool, assists in avoiding dead center locking, since it will be noted that pilot 2 must move more than half-way from its upper rest position to its lower rest position before the appropriate passageways are opened or closed sufficiently to cause the flow reversal that initiates movement of spool 1; hence, pilot 2 and spool 1 cannot, under field conditions, both be in positions of equilibrium at the same instant.

The positioning of the spool mechanism coaxially with the piston shaft is of particular importance. This positioning, compared with an eccentric location of the spool, permits use of a spool with a relatively larger cross-sectional area; this in turn allows use of a larger cross-sectional annular cavity between the narrowed portion of the spool and the smaller diameter of the stepped bore of the valve body, thus increasing the flow of fluid for a given overall diameter. (See, e.g. annular cavities 66 and 67 in FIG. 3.)

The pump system herein described is particularly useful in applications in which the above-ground pressurizing pump is driven by a photovoltaic source of power. The relatively small number of part needed and the relatively low inertial resistance of the reciprocating parts permit the system to operate even when solar energy input is minimal, as on a cloudy day or when the sun is not high in the sky.

Since certain changes may be made in the above apparatus without departing from the scope of the invention herein involved, it is intended that all matter contained in the above description or shown in the accompanying drawings shall be interpreted as illustrative and not in a limiting sense.

I claim:

1. In a hydraulic pumping system intended for pumping fluid from a below-ground well, said system comprising an above-ground reservoir and pressurizing pump, a submerged reciprocating pumping system including a shaft, at least two spatially separated cylindrical chambers, each enclosing a reciprocating piston concentrically mounted on said shaft and associated intake and relief valves, and valve switching means consisting in part of valve bodies immovably positioned between such chambers, together with tubing means and associated manifold means capable of conducting fluid between said reservoir and said submerged pumping system, the improvement in said valve switching means comprising:

pilot means adapted to be driven reciprocally between a first position and a second position by said reciprocating pistons;

spool means slidably and concentrically mounted on said shaft and adapted to be driven reciprocally between a first position and a second position by fluid released by the movement of said pilot means; and annular cavities and radial passages adapted to carry pressurized fluid through said valve switching means so as to cause the movement of said spool means in response to movement of said pilot means, whereby fluid is driven unidirectionally through said tubing means to said reservoir while said pistons are reciprocating.

2. The invention of claim 1 wherein said tubing means and associated manifold means are positioned eccentrically on one side of said valve switching means.

3. The invention of claim 2 wherein solar power is used to drive said pressurizing pump.

4. A hydraulic pumping system intended for pumping fluid from a below-ground well, said system comprising, in combination:

an above-ground reservoir and pressurizing pump;

a submerged reciprocating pumping system comprising:

a shaft;

at least two spatially separated chambers, each said chamber enclosing a reciprocating piston concentrically mounted on said shaft and associated intake and relief valves, said piston being so adapted as to provide a substantially fluid-tight seal with the inner walls of said chamber; and valve switching means consisting in part of valve bodies immovably positioned between said chambers, said valve switching means comprising:

pilot means adapted to be driven reciprocally between a first position and a second position by said pistons, spool means slidably and concentrically mounted on said shaft and adapted to be driven reciprocally between a first position and a second position by the movement of said pilot means; and annular cavities and radial passages adapted to carry pressurized fluid through said valve switching means; and tubing means and associated manifold means capable of conducting fluid between said reservoir and said submerged pumping system, whereby fluid is driven unidirectionally through said tubing means to said reservoir while said piston are reciprocating.

5. A hydraulic pumping system as defined in claim 4, wherein solar power is used to drive said pressurizing pump.

6. A hydraulic pumping system as defined in claim 4, wherein said tubing means and associated manifold means are positioned eccentrically on one side of said valve switching means.

7. A hydraulic pumping system as defined in claim 6, wherein solar power is used to drive said pressurizing pump.

8. In a hydraulic pumping system intended for pumping fluid from a below-ground well, the system including an above-ground reservoir and pressurizing pump, a submerged reciprocating pumping system including a shaft, at least two spatially separated cylindrical chambers, each said chamber enclosing a reciprocating piston concentrically mounted on the shaft and associated intake and relief valves, valve switching means consisting in part of valve bodies immovably positioned between the chambers, together with tubing means and associated manifold means capable of conducting fluid between the reservoir and the submerged pumping system, the valve switching means comprising:

pilot means arranged to be driven reciprocally by said pistons between a first position and a second position;

spool means concentrically mounted on said shaft and reciprocally driven between a first position and a second position by fluid released by the movement of said pilot means; and annular cavities and radial passages constructed and arranged to carry pressurized fluid through said valve switching means, in response to movement of said pilot means, to move said spool means, whereby fluid is driven unidirectionally through said tubing means to said reservoir while said pistons are reciprocating.

9. A hydraulic pumping system as defined in claim 8, wherein said tubing means and associated manifold means are positioned eccentrically on one side of said valve switching means.

10. A hydraulic pumping system as defined in claim 8, wherein solar power is used to drive said pressurizing pump.

* * * * *